United States Patent [19]

Burling

[11] Patent Number: 4,966,124

[45] Date of Patent: Oct. 30, 1990

[54] GRIP ASSEMBLY FOR ARCHERY BOW

[75] Inventor: Michael R. Burling, 7611 Holstein Rd., Toledo, Ohio 43617

[73] Assignee: Michael R. Burling, Toledo, Ohio

[21] Appl. No.: 182,442

[22] Filed: Apr. 18, 1988

[51] Int. Cl.[5] ..... F41B 5/00

[52] U.S. Cl. ..... 124/23.1; 124/88

[58] Field of Search ..... 124/88, 24 R, 23 R, 124/86

[56] References Cited

U.S. PATENT DOCUMENTS

| | | | |
|---|---|---|---|
| 2,854,965 | 10/1958 | Eberbach | 124/23 R |
| 3,397,685 | 8/1968 | Walker | 124/24 R |
| 3,407,799 | 10/1968 | Reynolds | 124/24 R |
| 3,416,508 | 12/1968 | Thompson | 124/24 R |
| 3,491,739 | 1/1970 | Scrobell | 124/23 R |
| 3,517,658 | 6/1970 | Shurts | 124/23 R |
| 3,538,902 | 11/1970 | Fowkes . | |
| 3,599,621 | 8/1971 | Scrobell | 124/23 R |
| 3,814,074 | 6/1974 | Wood | 124/88 X |
| 4,252,100 | 2/1981 | Rickard | 124/23 R |
| 4,457,287 | 7/1984 | Babington | 124/23 R |
| 4,881,514 | 11/1989 | Denslow et al. | 124/88 X |

*Primary Examiner*—Peter M. Cuomo

*Attorney, Agent, or Firm*—John R. Nelson

[57] ABSTRACT

A grip assembly for an archery bow installed on the riser of a bow to provide a frictionless pivot connection between the bow and the grip and which does not impart torque to the bow. Three styles of frictionless pivot connections are disclosed which include a pivot grip, a pull grip and a combination pull grip and pivot. The invention is adaptable to existing bows and may be installed by the user, or may be included by the manufacturer of the bow. The invention is adapted to several known styles of archer bows.

18 Claims, 3 Drawing Sheets

GRIP ASSEMBLY FOR ARCHERY BOW

SUMMARY OF THE INVENTION

In practicing archery, maintaining the bow in the line of the shot from the release of the bow string until the notch end of the arrow has passed the bow is critical to the accuracy of the shot. When the bow is drawn with no torque applied through the grip, the arrow direction and the sighting direction coincide. When torque is applied to a drawn bow, the arrow parallels the sighting direction, but the bow is aimed in the direction of the applied torque. This results in changing the direction of the bow, thereby effecting the accuracy of the shot.

It is, therefore, an object of this invention to provide a grip that is connected to the riser of the bow by a relatively frictionless pivot connector means and which does not impart torque to the bow during the shot. The various frictionless pivot connection means which have been tried and have achieved the purpose of the invention include either relatively sharply pointed pivot pin means, a spherical ball and bearing means, or a cable means (with a pull grip), as embodiments of the invention which will be further discussed hereinafter.

Further, the invention includes a pivot grip for a bow, a pull grip for a bow, or a combination (pull-pivot) grip for a bow, which the archer may install or have installed on existing styles of bow risers or on new bows, and which employ the principles of the invention. The superior results of the invention may be realized by using one of the grip devices hereinafter described.

And, since prior grips for the most part require a bow be designed and made specially for it, the grip of the present invention may be adapted and installed by the owner on most bows being manufactured at the present time.

In the accompanying drawings, there are illustrated various embodiments of the invention, including a preferred embodiment, and other objects and advantages of the invention will be apparent from the drawings and the following detailed description.

DETAILED DESCRIPTION

Figure 1:
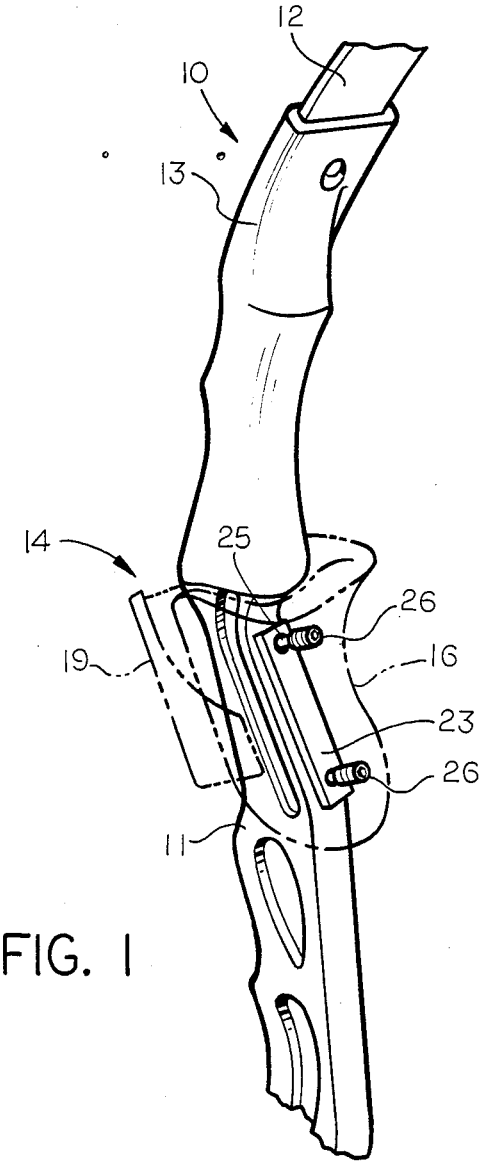
FIG. 1 is a partial view, in perspective, of an archery bow showing the grip assembly of the invention mounted on the riser of the bow.

On the drawings, FIG. 1 shows in part a compound archers bow 10 comprised of a central riser 11 and attached upper limb 12 and a lower limb (not shown). The riser and limb juncture is covered by a casing such as 13. The riser and limbs are made of metal alloy for strength, and lightweight characteristics of the bow. The casing is molded of plastic.

The present invention is adaptable to a bow such as is illustrated in FIG. 1, however, will be usable with a wide variety of archery bows. In this disclosure, the style of bow illustrated is but one example of use of the invention.

Figure 2:
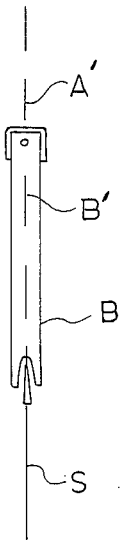
FIG. 2 is a schematic plan view of a bow, bow string and arrow showing the line of sight and line of flight of the arrow where both coincide for an accurate shot of the arrow in the line of sight.

FIG. 2 illustrates schematically the desired result of shooting an arrow in which the plane of bow B, of bow string S and the line of sight (and the plane of the arrow) A are in the common plane A, This illustrates a condition in which there is zero torque applied to the bow. When a bow is drawn with no torque applied through the grip, the flight of the arrow and the line of sight will coincide.

Figure 3:
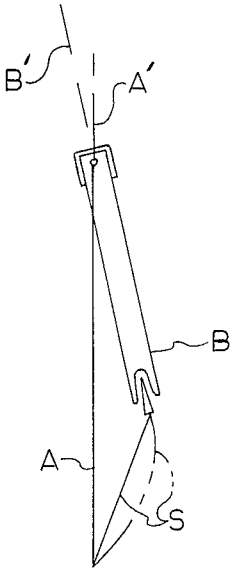
FIG. 3 is a schematic plan view like FIG. 2 but showing the effect of torque or rotation of the bow with respect to the line of sight and line of flight of the arrow producing an inaccurate shot of the arrow.

Torque is applied by pivoting the plane of the bow displacing it at an angle from the line of sight. FIG. 3 illustrates schematically the condition when torque is applied to the drawn bow. The arrow and sight direction A are in the plane A'. The bow B is in the plane B, which is now, due to the torque of the archer's wrist, etc., directed right or left (depending whether the shooter is right or left-handed). This changes the direction of the arrow and influences the accuracy of the archer.

The invention herein disclosed remedies this by providing a frictionless pivot point between the grip of the bow and the riser. Pivoting of the grip will not impart torque to the bow and the characteristics of FIG. 2 are achieved resulting in the higher degree of accuracy.

THE PIVOT GRIP EMBODIMENT

Figure 5:
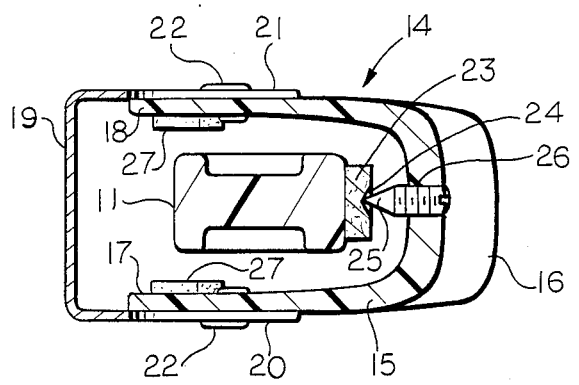
FIG. 5 is a sectional plan view along line 5—5 on FIG. 4.
Figure 4:
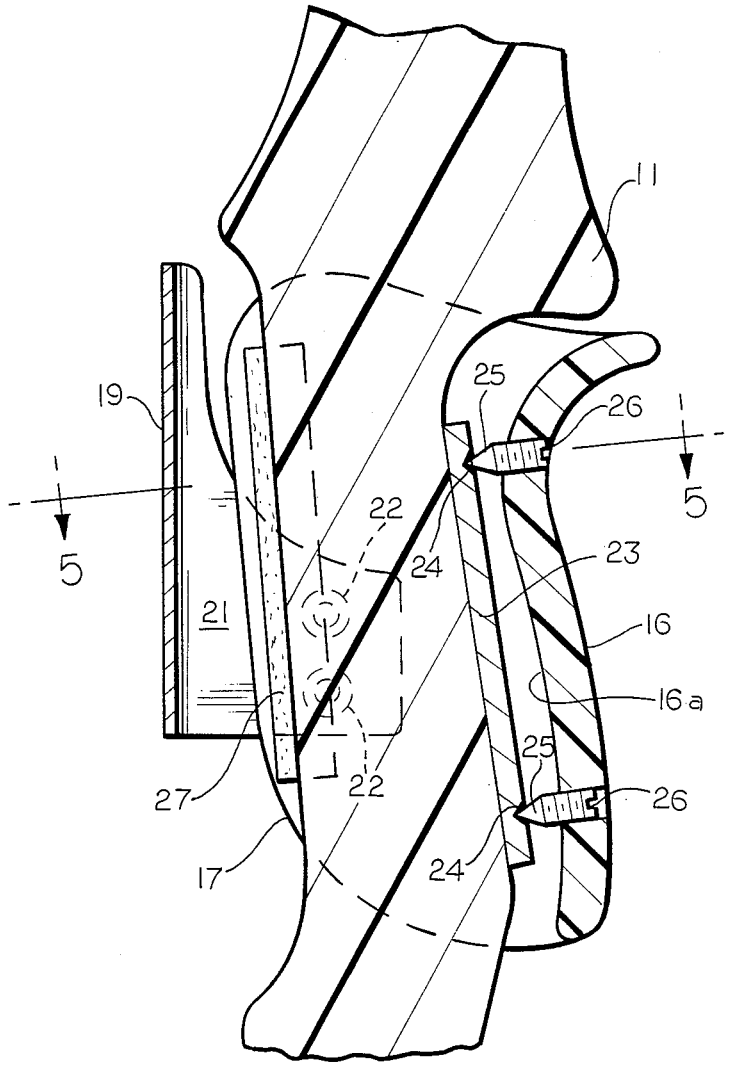
FIG. 4 is a sectional elevational view of the pivot grip embodiment of the invention.

In one form of the invention a "pivot grip" 14 is shown on FIGS. 1, 4 and 5, which comprises the hand grip 16 having a contoured back surface and sides 17 and 18 providing a clevis arrangement extending on either side of riser 11 of the bow. A U-shaped shield plate 19 is secured along its legs 20 and 21 to the sides 17 and 18, respectively, of the hand grip 16 by fasteners 22. The hand grip is preferably molded of plastic for appearance and contour, and the shield plate may be of plastic material or metal, etc.

As shown on FIG. 4, a bearing plate 23 is fastened to the back side (side nearest the archer) of the riser 11 by suitable means such as adhesive. Alternatively, bearing plate 23 may be incorporated in the bow riser design of the bow by the manufacturer. The present invention is versatile in that it may be added conveniently to existing bows by their owner/users.

Bearing plate 23 has two spaced-apart conical pivot seats 24 located on a vertical center line and the bearing plate is affixed on the vertical center of the bow. Pivot seats 24 provide an apex to receive pointed pivots 25 which are threaded and received in threaded apertures 26 through the back side of hand grip 16. The pivots 25 are sharper in contour than the apex of seats 24 which provide frictionless pivot points between the hand grip and the riser. In using the pivot grip assembly just described, the archer supports the bow by the bow string and the hand grip. The hand grip 16 is further provided with pads 27 of felt or like dampening material attached along the inside surface of each of side walls 17 and 18. Pads 27 dampen any vibration of the hand grip against the riser after the bow string is released in the shot of an arrow.

Figure 6:
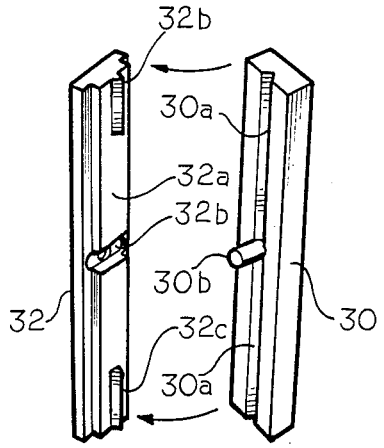
FIG. 6 is a perspective view of the bearing plate and pivots on the grip and riser, respectively, as used on another form of the invention.
Figure 7:
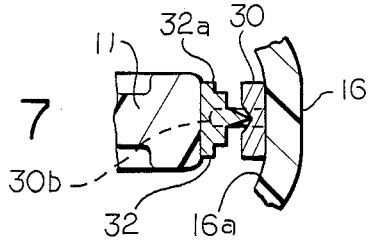
FIG. 7 is a fragmentary sectional plan view of the interengagement of the grip and bow riser illustrating one example of pivotal connection between them.

FIGS. 6 and 7 disclose a variant of the pivot grip embodiment in which an elongated member 30 is attached to the forward surface (away from the archer) 16*a* of the hand grip 16. An elongated plate member 32 is fastened and centered on the vertical center of the bow riser 11. Plate member 32 includes a longitudinally extending raised flat surface 32*a* narrower than the rear side base and longitudinally extending, spaced apart knife edges 32*b* and 32*c* protrude rearwardly of the riser. A central, elongated, oval slot 32*d* is provided in the rearward facing surface of member 32. The elongated member 30 fastened to the hand grip includes a central V-slot 30*a* extending centrally and vertically thereof in which the knife edges 32*b* and 32*c* each seat themselves for pivotal rocking movement. The centered forwardly projecting pin 30*b* protrudes from the member 30 and fits into slot 32*d* of the member 32. Pin 30*b* is oval shaped, the major axis being disposed in the long dimension of slot 32*d*. Pin 30*b* retains the vertical position of the hand grip 16 on the bow riser 11 during shooting. The knife edges 32*b* and 32*c* are sharper in angularity than the angularity of V-groove 30*a* and serve as frictionless pivots in the lateral direction. In use, the hand grip 16 is moved along the riser until pin 30*b* is inserted in slot 32*d*, whereupon the knife edges 32*b* and 32*c* are in the V-slot 30*a*. In drawing the bow, the force is transferred from hand grip 16 to the bow riser by the knife edges 32*b* and 32*c* in slot 30*a*. This frictionless connection of the grip and bow avoids applying torque to the bow.

Figure 8:
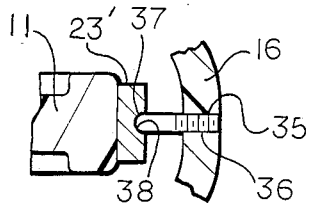
FIGS. 8–9 are enlarged fragmentary views illustrating various types of relatively frictionless engagement connections between the riser of the bow and the grip.
Figure 9:
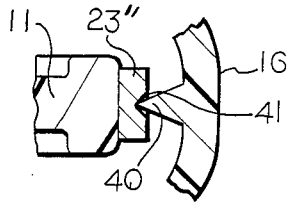
Figure 10:
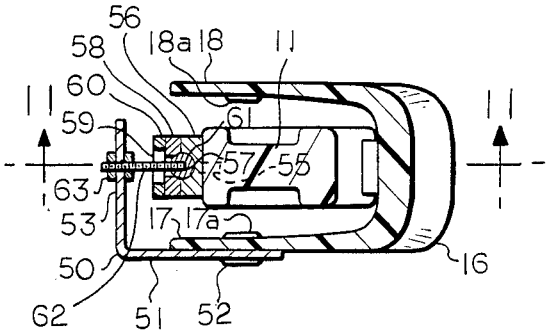
FIG. 10 is a sectional plan view showing a pull grip embodiment of the invention.

FIGS. 8–10 illustrate other variations which may be used in the pivot grip embodiment of the invention. The same reference numerals are applied to like parts.

In FIG. 8, an elongated bearing plate 23, is fastened on riser 11' similarly as described in FIG. 4. The hand grip 16 has a threaded aperture 35 and threaded pin 36 is assembled and held therein. The free end 37 of the pin is semispherical and it fits in a semispherical slot 38 in the bearing plate 23'. The radius of spherical surface 38 is larger than the radius of hemispherical pivot point 37 and the two engage to provide a frictionless pivot for the hand grip and riser to avoid applying torque during a shot.

FIG. 9 is a further variant of the pivot grip embodiment that is a frictionless pivot connection. The hand grip 16 has a pivot point 40 formed on the back surface facing away from the archer. Pivot point 40 is made integral in the casting of hand grip 16 and machined. The bearing plate 23'' is fastened to the near side of the riser 11, as previously described on FIG. 4. Bearing plate 23'' has a conical seat 41 located on the vertical center of the bow, seat 41 being of greater angularity than the point 40. The engagement of point 40 in the seat 41 provides still another form of a frictionless pivot connection between the grip and riser.

THE PULL GRIP EMBODIMENT

As distinguished from the pivot grip embodiment in which the drawing force on the bow is transmitted through the riser at the back side of the bow (side nearest the archer) to the hand grip. The pull grip embodiment has the drawing force on the bow transmitted through the front side of the riser (away from the archer) and to the hand grip.

Figure 11:
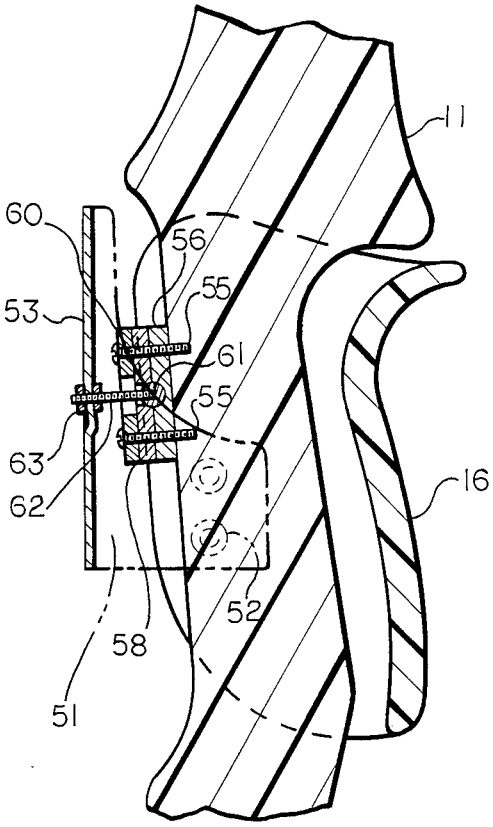
FIG. 11 is a sectional elevational view taken along line 11–11 on FIG. 10.

One form of this pull grip embodiment is shown on FIGS. 10 and 11. As explained earlier, similar parts are identified on the drawings by the same reference numerals.

The U-shaped hand grip 16 fits around the riser 11. A back plate 50 is assembled to one side or the other of hand grip 16 by cap screws 52 through side leg 51 and threaded into the threaded inserts 17*a* of side 17 of the hand grip. As shown on the drawings, FIG. 10 is set up for a right-handed archer. As such, the side leg 51 of the back plate is always along the fingers side of the hand on the grip. If a left-handed shooter uses this embodiment, the back plate is placed along the side wall 18; or opposite that shown on FIG. 10. The front leg 53 of the back plate is disposed at a right angle to its leg 51 and extends in front of and across riser 11 of the bow. A socket member 56 is attached to the front of riser 11 by screws 55.

Socket member 56 is abutted on the riser and fastened to it by screws 55. Member 56 includes a central hemispherical socket portion defining a spherical cavity 57 that is centered along the vertical center of the bow. An intermediate plate 58 lies against socket member 56 and further defines the spherical surface joined with an axial aperture 59 extending off the center of the sphere 57. Plate 58 is made of a material having a low coefficient of friction, such as Teflon. A cover plate 60 is used to receive the screws 55 and fasten the assembly onto the riser. A spherical ball 61 is threaded on the end of bolt 62 which extends through aperture 59 of the socket member and through a hole in the front leg 53 of back plate 50. The bolt is secured and adjusted in place by the lock nuts 63. Ball 61 is fitted and sized with the socket 57 to operate like a ball bearing in a semispherical race and as such provides a frictionless connection means between the hand grip and bow riser which avoids transmitting torque to the bow from the draw of the archer.

In the pull grip just discussed, the archer draws the bow applying resistance or holding pressure on the back side of the hand grip. This force is transmitted by the grip to the back plate 50 and into the ball that is within the socket assembly, this force going primarily from the ball surface onto the spherical socket surface of the assembly that is attached to the riser. By the frictionless connection supplied by the spherical ball and socket, torque in the hand grip will not be applied to the bow riser.

THE COMBINATION GRIP

Figure 12:
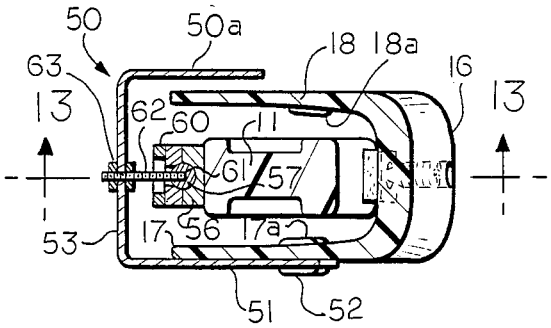
FIG. 12 is a sectional plan view like FIG. 11 showing another form of the pull grip.
Figure 13:
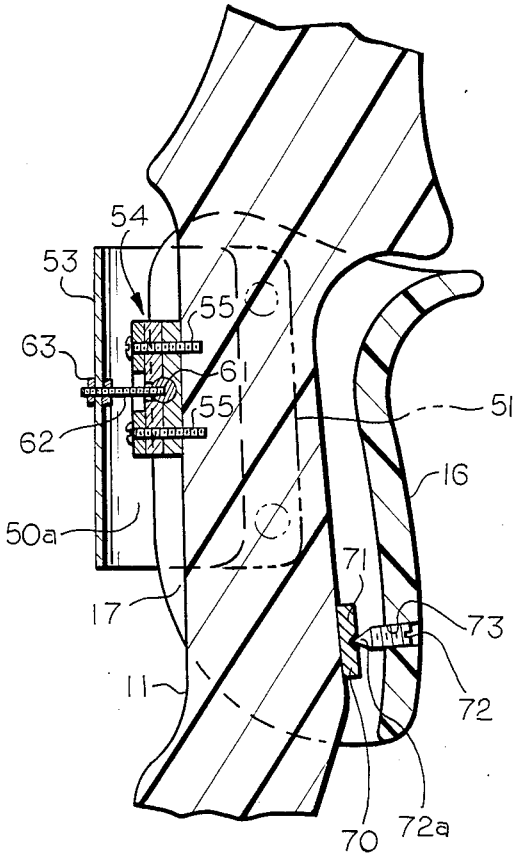
FIG. 13 is a sectional elevational view taken along line 13—13 on FIG. 12.

Within the principles of the invention, a third embodiment is presented and illustrated on FIGS. 12 and 13. The pull grip is attached according to the description of FIGS. 10 and 11. The same procedure is provided in this form of the invention in which the fingers of the right-handed archer will lie along the side leg 51 of the back plate 50. An opposite side 50*a* extends at a right angle from the front leg 53 to surround the inner end of the hand grip and side 50*a* is spaced from the side 18 of hand grip 16. The leg 50*a* is a support bracket which shields the riser from contact of the hand and fingers.

As was described under FIGS. 10 and 11, the back plate 50 may be reversed for a left-handed archer. Removing the cap screws 52 and the lock nuts 63, the back plate may be revolved 180 degrees and screws 52 inserted into the threaded inserts 18*a* in the side 18 of the hand grip. The bolt 62 is again inserted through the aperture of front leg 53 and the lock nuts 63 reapplied.

A bearing plate 70 is attached at the back of riser 11 and includes a conical seat 71 on its exposed surface. A set screw 72 is inserted in a threaded aperture 73 through hand grip 16. The plate 70 is located on the vertical center of the bow and vertically below the socket 57 of the member 54 so that it and the conical seat 71 are aligned on the vertical center of the bow. The combination of the spherical ball 61 and spherical socket 57 provide the principal frictionless pivot connection between the hand grip and the riser, plus the point 72*a* of the set screw 72 in conical seat 71 provides a stabilizing contact between the back side of the riser and the hand grip.

Figure 14:
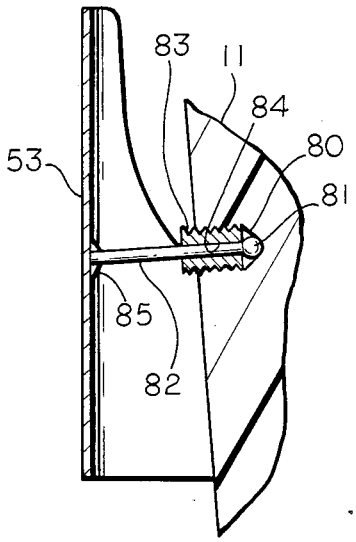
FIG. 14 is a fragmentary elevational view showing another variation of the pull grip.

Another variant form of the invention is shown on FIG. 14. This provides a connection between the back plate 53 and the riser 11. A hole 80 is tapped and threaded in the front surface of the riser along the vertical center of the bow. The inner end of hole 80 provides some clearance to contain the bead 81 on the end of flexible member 82 which may be in the form of a flexible cable with an internal enlargement at the inner end. A threaded plug 83 is screwed into the thread of hole 80 with the cable 82 extending through a center aperture 84 of plug 83. The outer end of cable 82 is attached to a snap-in fitting 85 on the inner surface of back plate 53. Cable 82 is provided to the correct length for attaching the hand grip in the fashion shown on either the pull grip of FIG. 11 or the combination grip of FIG. 13. In this form, the connection between the hand grip and the riser is frictionless by reason of the flexibility of cable 82.

The term "vertical center" and "vertical plane" of the bow as used in the description of the invention is intended to mean the longitudinal center or longitudinal axis thereof assuming the bow is used in a vertical attitude when shooting an arrow.

The term "frictionless connection" as used in the description is intended to mean a connection by which no torque can be transmitted from the one member to the other member connected to it.

The invention has been shown and described herein in several embodiments and variations thereof. It is recognized, however, that departures may be made therefrom including modifications apparent to a person skilled in the art which are within the scope of the invention as defined by the appended claims.

What is claimed:

1. In an archery bow having a central riser element and upper and lower limbs extending therefrom in the plane of the bow, the combination therewith of:

a grip assembly comprising a hand grip element having a back surface nearest the archer and depending sides providing a clevis arrangement extending around opposite sides of the riser element, and a U-shaped shield plate having spaced-apart legs, at least one of said legs being secured to one of the sides of the hand grip element, said shield plate and hand grip element together encircling the riser element shielding the archer's hand from the riser element, and a low friction connection means between said hand grip and bow riser elements comprising a pivot member connected to one of said elements and a pivot seat connected to the other of said elements, said pivot seat and said pivot member are disposed between the riser element and said back surface of the hand grip element, said connection means being characterized by providing a low friction contact to prevent imparting torque from the hand grip element to the riser element.

2. The combination of claim 1 in which the pivot member is connected to the hand grip element and the pivot seat is connected to the riser element.

3. The combination of claim 1 wherein the pivot member is connected to the back surface of the hand grip element and facing the riser element, and the pivot seat is connected to the back side of the riser element.

4. The combination of claim 3 in which the pivot member comprises a pointed pin having a radius at its outer end and the pivot seat comprises a slot.

5. The combination of claim 3 in which the pivot member comprises a pivot point of a sharp angularity and the pivot seat is a conical seat defining an apex, the sides of which are greater in angularity than the angularity of the point.

6. The combination of claim 5 in which the pivot seat includes a plurality of spaced conical seats disposed in a plane o the bow and the pivot member points are disposed in a plane of the bow and spaced apart to correspond to the plural seats.

7. The combination of claim 1 in which the pivot member is connected to the riser element and the pivot seat is connected to the hand grip element.

8. The combination of claim 7 in which the pivot member is connected to the back of the riser element facing the archer and the pivot seat is connected to the back surface of the hand grip element facing the riser element for receiving the pivot member.

9. The combination of claim 8 wherein the pivot member comprises a knife edge on the back of the riser extending along the plane of the bow and the pivot seat is a V-groove extending parallel to the plane of the bow, the knife edge being a sharper edge than the V-groove of said pivot seat.

10. The combination of claim 9 in which the pivot member includes a transverse slot, said knife edge being disposed longitudinally in the plane of the bow on either side of said slot, and said pivot seat includes a round pin adapted to fit in said oval slot, whereby said pin locates the knife edge in the V-groove and restricts movement between the two members in the plane of the bow.

11. The combination of claim 1 in which the U-shaped shield plate extends along one side of the riser element to shield the fingers of the hand of the archer holding said hand grip from making contact with the riser element.

12. The combination of claim 1 which includes dampening pads on the inside surface of each of the depending sides of the hand grip, the pads being intermediate said sides and the riser element.

13. A grip assembly for an archery bow having a central riser element extending in the plane of the bow, comprising a U-shaped hand grip element having a back surface and sides and adapted to fit around said riser element, said sides being spaced on either side of said riser element, a U-shaped shield member having spaced-apart legs, at least one of said legs being fastened to an adjacent side of said handle grip element, the riser element being disposed between the back surface of said hand grip element and said shield member, whereby said hand grip element and said shield, member prevent the hand of the archer from containing the riser element; and a connection means between said hand grip element and riser element of the bow, comprising at least one pivot seat on one of said elements, and a matching sharp pivot on the other of said elements, said connection means providing a low friction contact so as to avoid imparting torque from the hand grip element to the riser element.

14. The grip assembly for an archery bow of claim 13 in which the connection means is in the plane of the bow.

15. The grip assembly of claim 14 in which said connection means comprises a bearing plate adapted for attachment on the riser element of the bow and having at least one pivot point socket in the plane of the bow and a corresponding pivot point located on the back surface of the hand grip element engaging each said pivot socket, said pivot point being sharper than the corresponding said socket.

16. The grip assembly of claim 15 in which the pivot socket is a notch and the pivot point has a spherical bearing surface on its outer end, the sides of said notch being greater in angularity from its center than the sides of said pivot point.

17. The grip assembly of claim 15 in which the pivot point socket is a V-notch and the pivot point is a relatively sharp point.

18. The grip assembly of claim 17 in which there are plural pivot sockets on the bearing plate and corresponding plural sharp points on the and grip, each said point being engageable in one of said notches.

* * * * *